US010160108B2

(12) United States Patent
Beck

(10) Patent No.: US 10,160,108 B2
(45) Date of Patent: Dec. 25, 2018

(54) DRIVING-IN DEVICE AND METHOD FOR USING A DRIVING-IN DEVICE

(71) Applicant: Hilti Aktiengesellschaft, Schaan (LI)

(72) Inventor: Wolfgang Beck, Schwabsoien (DE)

(73) Assignee: Hilti Aktiengesellschaft, Schaan (LI)

( * ) Notice: Subject to any disclaimer, the term of this patent is extended or adjusted under 35 U.S.C. 154(b) by 435 days.

(21) Appl. No.: 14/888,478

(22) PCT Filed: Apr. 29, 2014

(86) PCT No.: PCT/EP2014/058672
§ 371 (c)(1),
(2) Date: Nov. 2, 2015

(87) PCT Pub. No.: WO2014/180706
PCT Pub. Date: Nov. 13, 2014

(65) Prior Publication Data

US 2016/0167210 A1 Jun. 16, 2016

(30) Foreign Application Priority Data

May 6, 2013 (EP) ..... 13166697

(51) Int. Cl.
*B25C 1/06* (2006.01)
*B25F 5/00* (2006.01)

(52) U.S. Cl.
CPC . *B25C 1/06* (2013.01); *B25F 5/00* (2013.01)

(58) Field of Classification Search
CPC ..... B25C 5/06; H02N 2/18; H02J 9/00; H02J 5/00

(Continued)

(56) References Cited

U.S. PATENT DOCUMENTS 5,227,943 A * 7/1993 Cargille ..... B64G 1/285 361/101
5,473,805 A * 12/1995 Wille ..... B21J 15/26 227/55

(Continued)

FOREIGN PATENT DOCUMENTS

CN 101689782 B 10/2013
WO WO 2007/048006 A2 4/2007
WO WO 2011/157775 A2 12/2011

OTHER PUBLICATIONS

Taiwanese Patent Office, Office Action in counterpart Taiwanese Application No. 103114777, dated Oct. 18, 2017.

(Continued)

*Primary Examiner* — Nathaniel Chukwurah
(74) *Attorney, Agent, or Firm* — Leydig Voit & Mayer

(57) ABSTRACT

A device for driving a fastening element into a substratum comprises a mechanical energy store for storing mechanical energy, an energy transfer apparatus for transferring energy from an electrical energy source to the mechanical energy store, and an electronic control apparatus, which is supplied with electrical energy by the electrical energy source and is suitable for initiating an energy withdrawal process when the supply of energy to the control apparatus by the electrical energy source is interrupted. In the energy withdrawal process, energy possibly stored in the mechanical energy store is converted into electrical energy and fed to the control apparatus in order to supply the control apparatus.

20 Claims, 3 Drawing Sheets

(58) Field of Classification Search
USPC ..... 227/1, 2, 9, 10, 11, 132, 129, 130
See application file for complete search history.

(56) References Cited

U.S. PATENT DOCUMENTS

| | | | | |
|---|---|---|---|---|
| 5,847,532 | A * | 12/1998 | Webster | H02M 3/1584 318/400.09 |
| 6,262,560 | B1 * | 7/2001 | Lionberg | H02J 7/0054 307/48 |
| 2003/0048004 | A1 * | 3/2003 | Fleming | H02J 3/005 307/64 |
| 2003/0137196 | A1 * | 7/2003 | Liran | H02J 9/08 307/64 |
| 2004/0182334 | A1 | 9/2004 | Grazioli et al. | |
| 2006/0087283 | A1 | 4/2006 | Phillips et al. | |
| 2008/0121404 | A1 | 5/2008 | Spasov et al. | |
| 2008/0122302 | A1 * | 5/2008 | Leininger | H02K 7/1823 310/50 |
| 2008/0203823 | A1 * | 8/2008 | Deppe | H02N 2/181 307/78 |
| 2009/0090759 | A1 | 4/2009 | Leimbach et al. | |
| 2010/0301688 | A1 | 12/2010 | Schulz et al. | |
| 2011/0303428 | A1 | 12/2011 | Roth et al. | |
| 2011/0303726 | A1 * | 12/2011 | Blessing | B25C 1/06 227/132 |
| 2013/0082084 | A1 | 4/2013 | Mandel et al. | |

OTHER PUBLICATIONS

International Bureau, International Search Report of Patent Application No. PCT/EP2014/058672, dated Nov. 6, 2014.

* cited by examiner

DRIVING-IN DEVICE AND METHOD FOR USING A DRIVING-IN DEVICE

CROSS-REFERENCE TO RELATED APPLICATIONS

The application is the U.S. National Stage of International Application Number PCT/EP2014/058672, filed on Apr. 29, 2014, which claims the benefit of European Patent Application Number 13166697.6, filed on May 6, 2013, which are each incorporated by reference.

TECHNICAL FIELD

The application relates to a device for driving a fastening element into an underlying surface and to a method for using such a device.

BACKGROUND OF THE INVENTION

Such devices typically comprise a piston for transmitting energy to the fastening element. The required energy must be provided in a very short time, which is why in so-called spring nailers, for example, a spring abruptly transmits the tensioning energy during the driving process to the piston and accelerates the latter toward the fastening element. The spring is cocked for this purpose with a cocking mechanism, which is in turn supplied by a battery.

WO 2011/157775 A2 describes a driving-in device in which such a spring is automatically uncocked as soon as a user has let go of the driving-in device. The energy is drawn down by a motor or fed back to the battery.

If the battery is inadvertently removed from such a fastener driving device while the spring is cocked, however, the automatic uncocking process cannot be controlled due to the interruption of the power supply.

BRIEF SUMMARY OF THE INVENTION

According to one aspect of the invention, a device for driving a fastening element into an underlying surface comprises a mechanical energy store for storing mechanical energy, an energy transfer apparatus for transferring energy from an electrical energy source to the mechanical energy store, and an electronic control apparatus supplied with energy by the electrical energy source. In the event of an interruption of the energy supply for the control apparatus from the electrical energy source, the control apparatus is suitable for initiating an energy withdrawal process in which energy stored in the mechanical energy store is converted into electrical energy and fed to the control apparatus as a power supply. Thereby the control apparatus is capable of controlling the energy withdrawal process despite the interrupted energy supply.

The device preferably comprises a generator, with which the energy stored in the mechanical energy store can be converted into electrical energy and supplied to the control apparatus.

According to one aspect of the invention, the device is characterized in that the energy transfer apparatus comprises an electric motor, with which the energy stored in the mechanical energy store can be converted into electrical energy and supplied to the control apparatus. An additional generator is therefore not necessary.

According to one aspect of the invention, the invention is characterized by an electronic circuit for regulating, preferably increasing, the electrical voltage of the energy withdrawn from the mechanical energy store and converted into electrical energy. The electronic circuit preferably comprises a step-up converter for increasing the electrical voltage of the energy withdrawn from the mechanical energy store and converted into electrical energy. According to one embodiment, the step-up converter comprises an inductor, a switching element, preferably a field-effect transistor, and a storage capacitor. The transfer apparatus, preferably the electric motor, especially preferably comprises an inductor of the step-up converter.

According to one aspect of the invention, the invention is characterized by an electronic circuit for regulating, preferably increasing, the electrical voltage of the energy withdrawn from the mechanical energy store and converted into electrical energy. The electronic circuit preferably comprises a step-up converter for increasing the electrical voltage of the energy withdrawn from the mechanical energy store and converted into electrical energy. According to one embodiment, the step-up converter comprises an inductor, a switching element, preferably a field-effect transistor, and a storage capacitor. The transfer apparatus, preferably the electric motor, especially preferably comprises an inductor of the step-up converter.

According to one aspect of the invention, in a method for using a device for driving a fastening element into an underlying surface, the device having a mechanical energy store for storing mechanical energy, an energy transfer apparatus for transferring energy from an electrical energy source to the mechanical energy store, and an electronic control apparatus supplied with electrical energy from the energy source, an energy withdrawal process is initiated if the energy supply for the control apparatus from the electrical energy source is interrupted, in which process the energy stored in the mechanical energy store is converted into electrical energy and fed to the control apparatus as a power supply.

According to one aspect of the invention, the method is characterized in that, if the supply of energy by the energy source is interrupted, the control apparatus controls the energy withdrawal process.

According to one aspect of the application, a device for driving a fastening element into an underlying surface comprises an energy transmission element for transmitting energy from the mechanical energy store to the fastening element. The energy transmission element can preferably be moved in the direction of a setting axis between an initial position and a setting position, the energy transmission element being situated in the initial position before the driving process and in the setting position after the driving process. Setting direction will be understood hereinafter as the direction from the initial position to the setting position.

According to one aspect of the application, the energy transfer apparatus is suitable for conveying the energy transmission element from the setting position to the starting position. The electrical energy source is preferably a single-use battery or a rechargeable battery. The device preferably comprises the energy source.

According to one aspect of the application, the energy transfer apparatus is suitable for conveying the energy transmission element from the setting position in the direction of the initial position without transferring energy to the mechanical energy store. This makes it possible for the mechanical energy store to absorb or discharge energy without moving the energy transmission element into the setting position. The energy store can thus be discharged without a fastening element being driven out of the device.

According to one aspect of the application, the energy transfer apparatus is suitable for transferring energy to the mechanical energy store without moving the energy transmission element.

The control apparatus preferably supplies the motor with power via a first electrical line in commuted phases.

According to one aspect of the application, the energy transfer apparatus comprises a motor with a motor output which is uninterruptibly force-coupled to the mechanical energy store. Movement of the motor output causes charging or discharging of the energy store and vice versa. The flow of force between the motor output and the mechanical energy store preferably cannot be interrupted, by means of a clutch for instance.

According to one aspect of the application, the device comprises a safety mechanism, by which the electrical energy source is or can be coupled to the device in such a manner that the mechanical energy store is automatically uncocked if the electrical energy store is disconnected from the device. Energy stored in the mechanical energy store is preferably drawn down in a controlled manner.

According to one aspect of the application, the device comprises a retaining apparatus, which retains the stored energy in the mechanical energy store and enables a discharging of the mechanical energy store if the electrical energy source is disconnected from the device.

According to one aspect of the application, the safety mechanism comprises an electromechanical actuator that automatically unlocks a blocking apparatus if the electrical energy source is disconnected from the device.

According to one aspect of the application, the device comprises a coupling and/or braking apparatus for drawing down the energy stored in the mechanical energy store in a controlled manner.

According to one aspect of the application, the safety mechanism comprises at least one safety switch. which short-circuits phases of the electric drive motor in order to draw down the energy stored in the mechanical energy store in a controlled manner when the mechanical energy store is discharged. The safety switch is preferably constructed as a normally closed electronic switch, preferably as a JFET.

According to one aspect of the application, the motor comprises three phases and is driven via a 3-phase motor bridge circuit with free-wheeling diodes, which rectify the voltage generated during discharging of the mechanical energy store.

BRIEF DESCRIPTION OF THE SEVERAL VIEWS OF THE DRAWING(S)

Embodiments of a device for driving fastener elements into an underlying surface will be described in detail below using examples, with reference to the drawings. In the drawing.

DETAILED DESCRIPTION OF THE INVENTION

Figure 1:
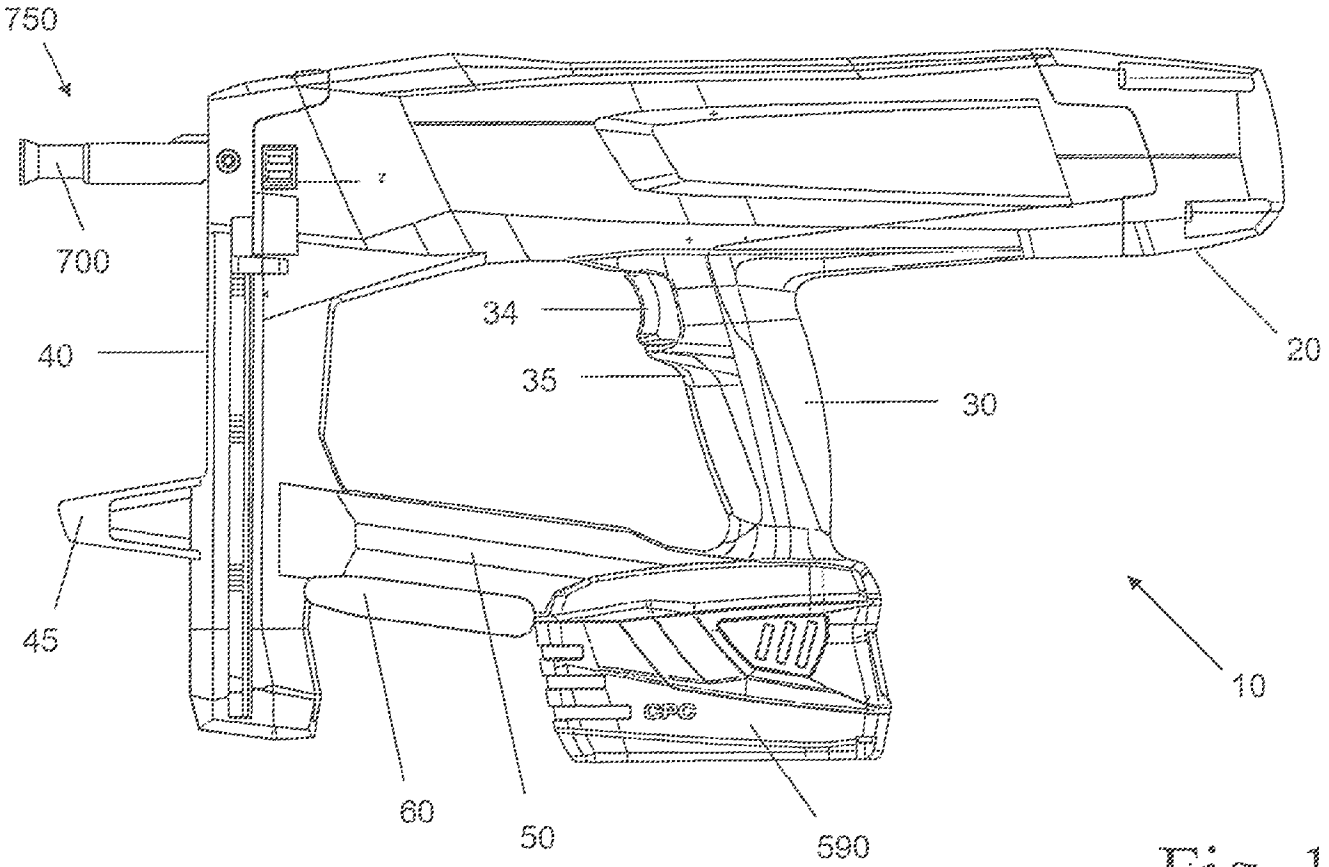
FIG. 1 shows a side view of a driving-in device.

In a side view, FIG. 1 shows a driving-in device 10 for driving a fastening element such as a nail or bolt into an underlying surface. The driving-in device 10 has an energy transmission element, not shown, for transmitting energy to the fastening element, as well as a housing 20 that houses the energy transmission element and a drive unit, likewise not shown, for conveying the energy transmission element.

The driving-in device 10 further comprises a handle 30, a magazine 40 and a bridge 50 connecting the handle 30 to the magazine 40. The magazine is not removable. An energy store configured as a rechargeable battery 590 and a scaffold hook 60 for suspending the driving-in device 10 on a scaffold or the like are mounted on the bridge 50. A trigger 34 and a handle sensor configured as a manual switch 35 are arranged on the handle 30. The driving-in device 10 further comprises a guide channel 700 for guiding the fastening element and a pressing apparatus 750 for recognizing a distance of the driving-in device 10 from an underlying surface, not shown. Alignment of the driving-in device perpendicular to an underlying surface is assisted by an alignment aid 45.

Figure 2:
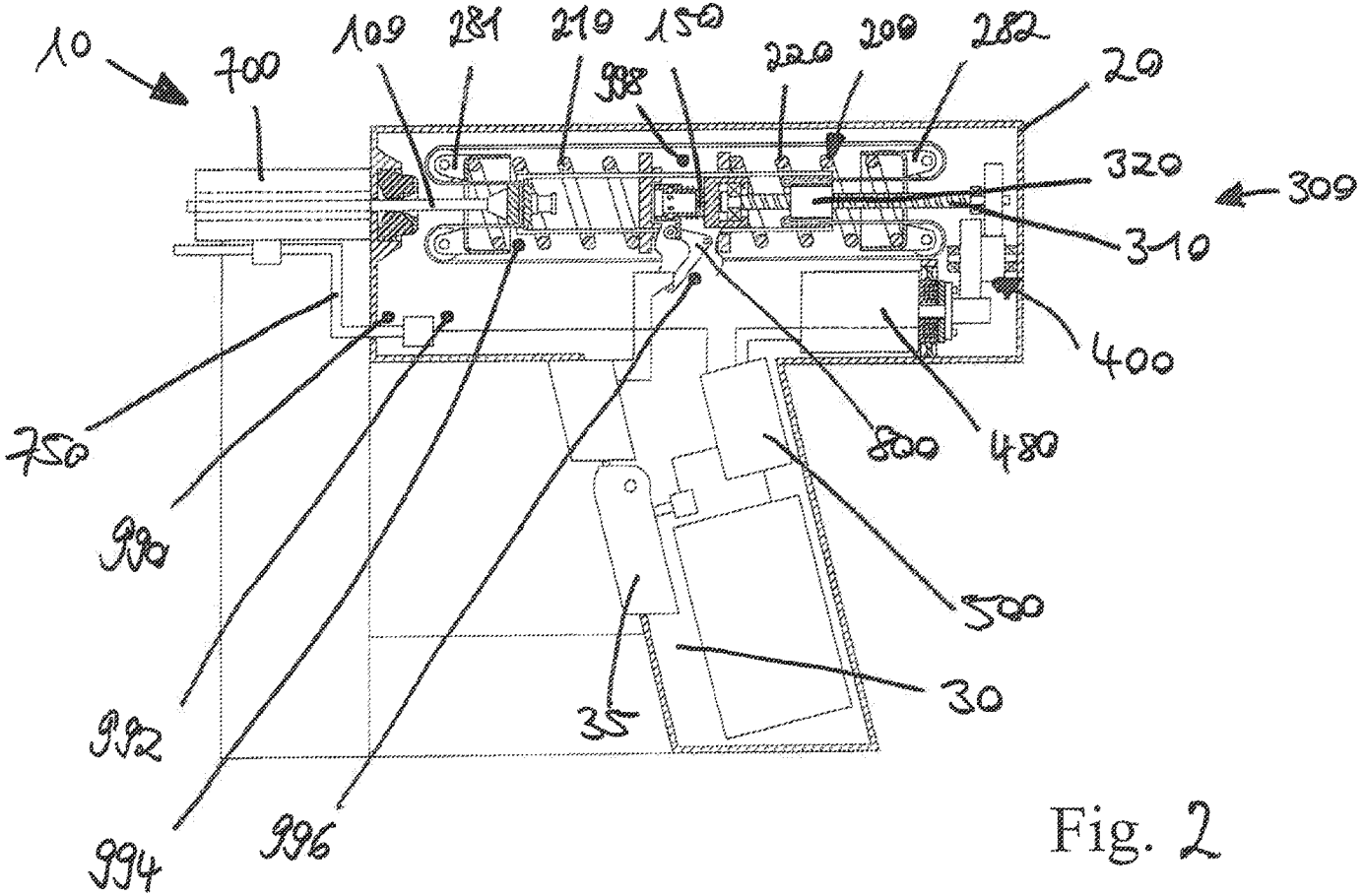
FIG. 2 shows a structural diagram of a driving-in device.

FIG. 2 shows a schematic view of a driving-in device 10 according to the invention. The driving-in device 10 comprises a housing 20, in which a piston 100, a coupling apparatus 150 held closed by a retaining element constructed as a pawl 800, a spring 200 having a front spring element 210 and a rear spring element 220, a roller train 260 having a force deflector constructed as a belt 270, a front roller mount 281 and a rear roller mount 282, a spindle drive 300 having a spindle 310 and a spindle nut 320, a gear unit 400, a motor 480, and a control apparatus 500 are housed. In one embodiment, not shown, the force deflector is constructed as a cable.

The driving-in device 10 further comprises a guide channel 700 for a fastening element and a pressing apparatus 750. The housing further 20 comprises a handle 30 on which a manual switch 35 is arranged.

The control apparatus 500 communicates with the manual switch 35 and with a plurality of sensors 990, 992, 994, 996, 998 in order to detect the operating status of the driving-in device 10. The sensors 990, 992, 994, 996, 998 each have a Hall probe, which detects the movement of a magnet armature, not shown, which is arranged on, more particularly fastened to, the respective element to be detected.

A forward movement of the pressing apparatus 750 is detected with guide channel sensor 990, which detects that the guide channel 700 has been removed from the driving-in device 10. The pressing sensor 992 detects a movement of the pressing apparatus 750 to the rear, which indicates that the driving-in device 10 is pressed against an underlying surface. The roller mount sensor detects a movement of the front roller mount 281, which indicates whether the spring 200 has been cocked. The pawl sensor 996 detects a movement of the pawl 800, which indicates whether the coupling apparatus 150 is held in its closed state. Finally, the spindle sensor 998 detects whether the spindle nut 320, or a return rod fixed to the spindle nut 320, is in the furthest-back position.

In addition, a bolt guide sensor preferably supplies the information regarding whether the bolt guide has been attached to the nose of the tool or has been removed. A trigger sensor preferably supplies the information regarding whether the trigger has been pulled. A piston sensor preferably supplies the information regarding whether the energy transmission element is in its initial position or in the setting position. A belt sensor preferably supplies the information regarding whether the force transmission element is in a cocked or uncocked position. Hall sensors, inductive sensors or switches, capacitive sensors or switches, or mechanical switches can be used as sensors. The driving tool preferably has a flexible circuit board on which some or all sensors are mounted and via which the sensors are connected to the control apparatus. This facilitates installation of the sensors during production of the driving tool.

The control apparatus preferably comprises a processor, especially preferably a microprocessor, for processing the sensor signals and/or other data, particularly information regarding amperages, voltages and the temperature of the electronics. A sensor board preferably processes the sensor signals, particularly those of the spindle sensor, the roller mount sensor, the pawl sensor, the bolt guide sensor or the pressing sensor. A motor control apparatus preferably processes the signal for the motor commutation. The battery controller arranged in the battery preferably processes information regarding the temperature, the type, the charge state and any malfunctions that have occurred in the battery.

The control apparatus additionally processes the temperature of the motor, the electronics, the ambient air and/or the battery, wherein the signal for the battery temperature can also be used by battery electronics inside the battery in order to identify a battery fault. In addition, the control apparatus preferably processes the amperage drawn from the battery, the amperage of individual commutated phases, the voltage at the battery contacts, the voltage at the DC link of a power bridge, the voltage at individual components, especially sensors, and/or the rotational speed of the motor, wherein the rotational speed of the motor is detected based on the switched commutation steps, a mutual induction, or by means of position sensors and/or switches in the motor, for example. The control apparatus preferably communicates with a battery controller in the battery. In particular, information is exchanged such as a power requirement, a number of cycles worked with the battery in use, a charge state, the model, the maximum amperage or the maximum voltage of a respective battery.

In order to make an optimized cocking process possible, even for different battery states and batteries, the power for the motor is preferably controlled based on the voltage present at the battery contacts and/or the DC link. The full power is applied to the motor until the voltage has dropped to a defined value, for example 12 V. If this value is reached, the controller reduces the power and continues to control to this voltage value. To keep the current to the motor from becoming too high in case of a high-powered battery, a current limiting regulator is also used, which ensures that a predetermined amperage is not exceeded. The tool operating process can be ensured and optimized with these control systems even despite differing battery power. These parameters can be adjusted by the controller to different types of batteries and conditions.

The control apparatus of the driving-in device 10 is suitable for initiating an energy withdrawal process if the energy supply for the control apparatus by the electrical energy source has been interrupted, i.e. if a user inadvertently removes the battery from the driving-in device 10, for example. In the energy withdrawal process, energy that is possibly stored in the mechanical energy store is converted with the aid of the electric motor into electrical energy. The electric motor operates in that case as a generator, the electrical energy of which is fed to the control apparatus for supplying power. Thereby the control apparatus is capable of controlling the energy withdrawal process despite the interrupted energy supply.

Figure 3:
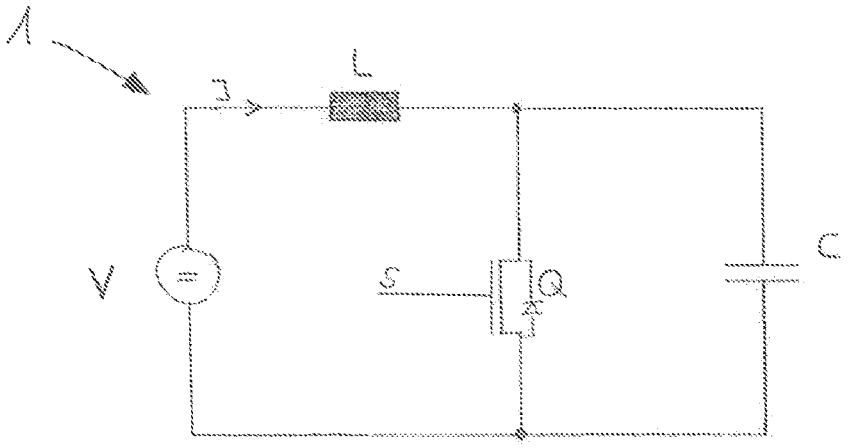
FIG. 3 shows a circuit diagram of a step-up converter.

With the aid of the step-up converter circuit 1 schematically shown in FIG. 3, for example, the electrical voltage is controlled for this purpose, more particularly increased, to a value that can be used for controlling. The step-up converter 1 comprises an inductor L, a switching element S that has a field-effect transistor, and a storage capacitor C. In this way, an output voltage that is higher than an input voltage V can be generated at the storage capacitor C. A current I flows in the direction of the arrow.

Figure 4:
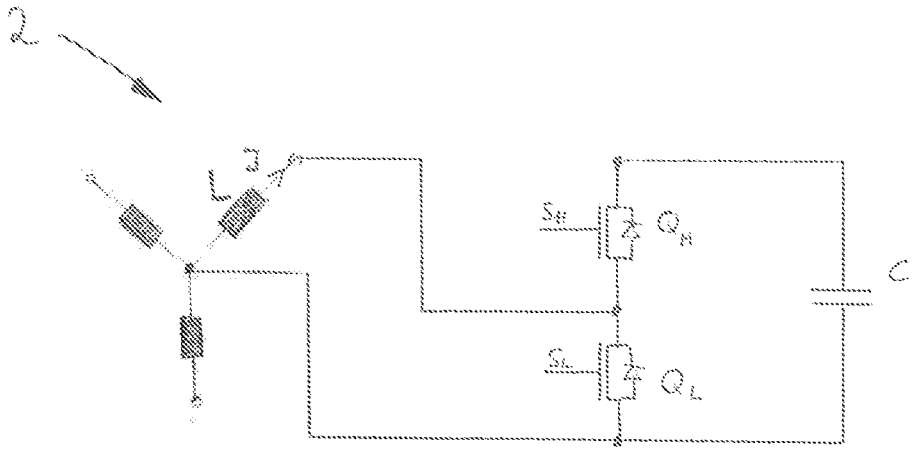
FIG. 4 shows a circuit diagram of an arrangement having a motor and step-up converter.

An arrangement 2 having a motor and a step-up converter is schematically shown in FIG. 4. In the arrangement. 2, a motor winding L is used as the inductor, a switching bridge $S_H$, $S_L$ as the switching element, and a buffer capacitor C as the storage capacitor for the step-up converter, so that no additional electronic components are required for providing the step-up converter. If the motor is driven as a generator, the desired behavior of the step-up converter circuit 2 can be generated by suitable driving of the field-effect transistors of the switching bridge $S_H$, $S_L$. A generator operation of the motor without stepping up the voltage can also be achieved, if desired, by suitable driving of the field-effect transistors of the switching bridge $S_H$, $S_L$. It is possible to control the voltage at the buffer capacitor C to any desired values by selecting the desired mode.

The control apparatus detects the loss of the battery if removed. By suitable driving of the motor, the supply voltage of the control apparatus can be maintained with the aid of the invention and optionally regulated to a constant value, whereby secure operation of the control apparatus is guaranteed as long as energy is present in the mechanical energy store. It is additionally possible to control the speed of the energy withdrawal process in such a manner that the supply voltage of the control apparatus does not break down.

The invention claimed is:

1. A device for driving a fastening element into an underlying surface, the device having a mechanical energy store for storing mechanical energy, an energy transfer apparatus for transferring energy from an electrical energy source to the mechanical energy store, and an electronic control apparatus supplied with an electrical energy supply from the electrical energy source, the electronic control apparatus initiating energy withdrawal if the electrical energy supply for the electronic control apparatus from the electrical energy source is interrupted, converting the mechanical energy stored in the mechanical energy store into electrical energy, which is fed to the electronic control apparatus as a power supply.

2. The device according to claim 1, further comprising a generator, with which the mechanical energy stored in the mechanical energy store is converted into electrical energy and supplied to the electronic control apparatus.

3. The device according to claim 2, wherein the energy transfer apparatus comprises an electric motor, with which the mechanical energy stored in the mechanical energy store is converted into electrical energy and supplied to the control apparatus.

4. The device according to claim 3, further comprising an electronic circuit for regulating the electrical voltage of the mechanical energy withdrawn from the mechanical energy store and converted into electrical energy.

5. The device according to claim 2, further comprising an electronic circuit for regulating the electrical voltage of the mechanical energy withdrawn from the mechanical energy store and converted into electrical energy.

6. The device according to claim 5, wherein the electronic circuit comprises a step-up converter for increasing the electrical voltage of the mechanical energy withdrawn from the mechanical energy store and converted into electrical energy.

7. The device according to claim 2, further comprising an energy transmission element moveable between an initial position and a setting position for transmitting energy to a fastening element.

8. The device according to claim 1, wherein the energy transfer apparatus comprises an electric motor, with which the mechanical energy stored in the mechanical energy store is converted into electrical energy and supplied to the electronic control apparatus.

9. The device according to claim 8, further comprising an electronic circuit for regulating the electrical voltage of the mechanical energy withdrawn from the mechanical energy store and converted into electrical energy.

10. The device according to claim 8, further comprising an energy transmission element moveable between an initial position and a setting position for transmitting energy to a fastening element.

11. The device according to claim 1, further comprising an electronic circuit for regulating the electrical voltage of the mechanical energy withdrawn from the mechanical energy store and converted into electrical energy.

12. The device according to claim 11, wherein the electronic circuit comprises a step-up converter for increasing the electrical voltage of the mechanical energy withdrawn from the mechanical energy store and converted into electrical energy.

13. The device according to claim 12, wherein the transferring apparatus comprises an inductor of the step-up converter.

14. The device according to claim 13, wherein the transferring apparatus comprises an electric motor.

15. The device of claim 11, wherein the electronic circuit increases the electrical voltage of the mechanically energy withdrawn from the mechanical energy store and converted into electrical energy.

16. The device according to claim 1, further comprising an energy transmission element moveable between an initial position and a setting position for transmitting energy to a fastening element.

17. The device according to claim 1, wherein the mechanical energy store comprises a spring.

18. The device according to claim 17, wherein the spring comprises a helical spring.

19. A method for using a device for driving a fastening element into an underlying surface, the device having a mechanical energy store for storing mechanical energy, an energy transfer apparatus for transferring energy from an electrical energy source to the mechanical energy store, and an electronic control apparatus supplied with an electrical energy supply by the electrical energy source, comprising initiating energy withdrawal if the electrical energy supply for the electronic control apparatus from the electrical energy source is interrupted, converting the mechanical energy stored in the mechanical energy store into electrical energy, and feeding the electrical energy to the electronic control apparatus as a power supply.

20. The method according to claim 19, wherein the control apparatus controls the energy withdrawal.

* * * * *